US006784152B2

(12) United States Patent
Keys

(10) Patent No.: US 6,784,152 B2
(45) Date of Patent: Aug. 31, 2004

(54) POLYQUAT ANIONIC SCAVENGERS FOR RINSE CYCLE FABRIC SOFTENERS

(75) Inventor: Robert O. Keys, Columbus, OH (US)

(73) Assignee: Goldschmidt Chemical Corporation, Hopewell, VA (US)

( * ) Notice: Subject to any disclaimer, the term of this patent is extended or adjusted under 35 U.S.C. 154(b) by 195 days.

(21) Appl. No.: 10/142,640

(22) Filed: May 10, 2002

(65) Prior Publication Data

US 2002/0173443 A1 Nov. 21, 2002

Related U.S. Application Data

(63) Continuation-in-part of application No. 09/558,673, filed on Apr. 26, 2000, now abandoned.

(51) Int. Cl.[7] ..... C11D 1/645
(52) U.S. Cl. ..... 510/515
(58) Field of Search ..... 510/515, 522, 510/527

(56) References Cited

U.S. PATENT DOCUMENTS

| | | | |
|---|---|---|---|
| 4,155,855 | A | 5/1979 | Goffinet et al. |
| 4,442,013 | A | 4/1984 | Fraikin et al. |
| 5,205,960 | A | 4/1993 | Kristopeit et al. |
| 5,474,690 | A | 12/1995 | Wahl et al. |
| 5,474,691 | A | 12/1995 | Severns |
| 5,705,474 | A | 1/1998 | Severns et al. |
| 5,759,990 | A | 6/1998 | Wahl et al. |
| 5,767,062 | A | 6/1998 | Trinh et al. |
| 6,083,899 | A | 7/2000 | Baker et al. |
| 6,248,710 | B1 | 6/2001 | Bijsterbosch et al. |

FOREIGN PATENT DOCUMENTS

| | | |
|---|---|---|
| EP | 0 803 498 A1 | 10/1997 |
| GB | 2 320 714 A | 7/1998 |
| WO | WO 94/20597 | 9/1994 |
| WO | WO 98/12292 | 3/1998 |

*Primary Examiner*—John R. Hardee
(74) *Attorney, Agent, or Firm*—Scully, Scott, Murphy & Presser

(57) ABSTRACT

A rinse cycle fabric softener concentrate having improved softening properties consisting essentially of a blend of at least one polyquat and a cationic fabric softener agent selected from the group consisting of ester-containing quaternary ammonium compounds, amido amine quaternary ammonium compounds, imidazoline quats and mixtures and salts thereof.

24 Claims, No Drawings

POLYQUAT ANIONIC SCAVENGERS FOR RINSE CYCLE FABRIC SOFTENERS

RELATED APPLICATIONS

The present application is a continuation-in-part application of U.S. application Ser. No. 09/558,673, filed Apr. 26, 2000 abandoned.

FIELD OF THE INVENTION

The present invention relates to fabric softeners, and more particularly to fabric softener concentrates that are added during the rinse cycle of a laundering process. Specifically, the present invention relates to a rinse cycle fabric softener concentrate that includes at least one polyquatemary (polyquat) ammonium anionic scavenger and at least one cationic quaternary ammonium fabric softener agent. The rinse cycle fabric softener concentrate of the present invention containing the polyquatemary ammonium anionic scavenger exhibits improved performance, i.e., softening, dye transfer inhibition, higher solids formulations and improved water dispersibility, as compared to prior art fabric softeners that do not contain the anionic scavenger described herein.

BACKGROUND OF THE INVENTION

In the field of laundering, it is well known to add a liquid fabric softener containing at least one fabric softening agent such as a cationic quaternary ammonium compound or salt thereof directly into the laundering process. The addition of the liquid fabric softener typically occurs during the rinse cycle itself. Although some improved softness may arise from the use of prior art fabric softeners, the overall softening performance of prior art fabric softeners is hindered due to high levels of residual anionics which are typically present in the washing liquor; the high level of residual anionics in the laundry liquor is the result of utilizing detergents that contain a high concentration of anionic surfactants which are not typically removed prior to the rinsing cycle. This is particularly the case in North America where high levels of anionic surfactants are employed in the detergent, and little or no additional (single rinse cycle following wash cycle) rinsing occurs prior to the addition of the fabric softener.

The hindered softening performance of prior art fabric softeners can be attributed to the high affinity that the cationic softening agents have for negatively charged species and/or surfaces. When high levels of anionics are present in the laundering liquor, the anionics compete with the negatively charged surfaces of the laundered fabric for the cationic fabric softener agent and complexation of the anionics and the cationic fabric softener agent occurs. Complexation of the anionics with the cationic fabric softener agent is undesirable since it significantly reduces the overall amount of fabric softener agent present in the rinse cycle that is needed to obtain a high degree of softening. Thus, because of the reduced levels of fabric softener agents in the laundry liquor, prior art fabric softeners can not achieve a high degree of softness.

Attempts have been made in the prior art to increase the amount of cationically charged species present in the laundry liquor. For example, it is known to add so-called "charge boosters" to fabric softeners in order to increase the amount of positively charged species present in the laundry liquor during the rinse cycle. Illustrative examples of some prior art charge boosters, which are disclosed in WO 94/20597, U.S. Pat. Nos. 5,759,990, and 5,474,690, for example, include, but are not limited to:

(i) Quaternary ammonium compounds having the formula:

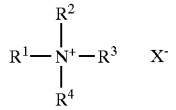

wherein $R^1$, $R^2$, $R^3$ and $R^4$ are independently $C_{1-22}$ alkyl, $C_{3-22}$ alkenyl, $R^5—Q(CH_2)_m—$, where $R^5$ is a $C_{1-22}$ alkyl, and mixtures thereof; Q is a carbonyl unit; m is from 1 to 6, and X is an anion;

(ii) Polyvinyl amines having the formula

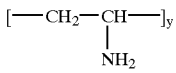

wherein y is from 3 to about 5000. Optionally, one or more of the polyvinyl amine backbone $—NH_2—$ unit hydrogens can be substituted with an alkyleneoxy moiety;

(iii) Polyalkylenimines having the formula

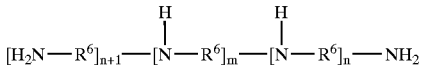

wherein each $R^6$ is independently a $C_{2-4}$ alkylene, $C_{3-8}$ substituted alkylene and mixtures thereof; the value of m is from 2-700 and the value of n is from 0 to 350. Optionally, one or more of the polyvinyl amine backbone $—NH_2—$ unit hydrogens can be substituted with an alkyleneoxy moiety;

(iv) Poly-quaternary ammonium compounds having the formula:

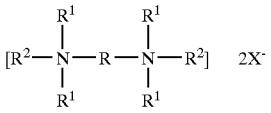

wherein R is substituted or unsubstituted $C_{2-12}$ alkylene, substituted or unsubstituted $C_{2-12}$ hydroxyalkylene; each $R^1$ is independently $C_{1-4}$ alkyl, each $R^2$ is independently $C_{1-22}$ alkyl, $C_{3-22}$ alkenyl, $R^5—Q—(CH_2)_m—$, where $R^5$ is $C_{1-22}$ alkyl, $C_{3-22}$ alkenyl, and mixtures thereof; m is from 1 to 6; Q is a carbonyl unit; and X is an anion; and (v) Cationic polymers such as amine salts or quaternary ammonium salts.

U.S. Pat. No. 6,083,899 to Baker, et al. (and the corresponding International Application WO 98/12292) provide a fabric softener composition that has enhanced softening benefits which comprises at least one fabric softener active and at least one cationic charge booster. The charge boosters disclosed in the Baker, et al. patent have structural formulas that are similar to charge boosters (i)–(iv) described above. In accordance with the disclosure of Baker, et al., the charge boosters reportedly increase the performance of cationic fabric softener actives that have diminished or insufficient charge density to a level which allows the low charge density surface active agent to be used in fabric softening formulations. Moreover, the Baker, et al. patent indicates that the cationic charge boosters have the effect of increasing the net cationic charge concentration independent of the intrinsic properties of the softening active.

Although prior art charge boosters are known, there is still a need for developing new and improved charge boosters (hereinafter referred to as "anionic scavengers") that serve to further increase the level of cationic active agent present in the rinse cycle of a laundering process. Moreover, prior art fabric softener formulations that include the above mentioned charge boosters typically require a separate polymeric dye transfer inhibition agent that prevents dye transfer during laundering. The addition of a separate dye transfer agent increases the number of processing steps in formulating the fabric softener. The additional processing steps result in an increased cost in producing the fabric softener which is passed along to the consumer.

In view of the above mentioned drawbacks with prior art rinse cycle fabric softeners, it would be extremely beneficial if a new and improved rinse cycle fabric softener concentrate was developed that was capable of providing improved softness as well as inhibiting dye transfer, without the need of adding separate ingredients to accomplish the aforementioned properties.

SUMMARY OF THE INVENTION

The present invention provides a rinse cycle fabric softener concentrate that has improved fabric softening capabilities, while being capable of inhibiting dye transfer without the need of utilizing separate ingredients which carry out the aforesaid functions. Specifically, the rinse cycle fabric softener concentrate of the present invention is a blend of quaternary ammonium compounds that consists essentially of:

(i) from about 3 to about 40 weight % of at least one polyquat selected from the group consisting of:

(a) a quat having structural formula (I):

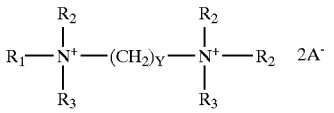

(I)

where $R_1$ is a $C_{10-24}$ alkyl, an ester having the formula $R_1C(O)OR$— where $R_1$ is defined above and R is a substituted or unsubstituted $C_{1-6}$ alkylene, or an amide having the formula $R_1C(O)NR$— where $R_1$ and R are as defined above; each $R_2$ independently is a —$(AO)_{1-6}H$ group where A is a $C_{2-4}$ straight chained or branched alkyl; each $R_3$ independently is a $C_{1-6}$ alkyl; Y is from 1 to 6 and A is an anion, (b) a quat having structural formula (II):

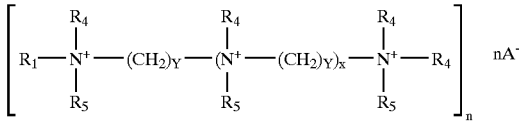

(II)

wherein $R_1$ is a $C_{10-24}$ alkyl, an ester having the formula $R_1C(O)OR$— where $R_1$ is defined above and R is a substituted or unsubstituted $C_{1-6}$ alkylene, or an amide of the formula $R_1C(O)NR$— where $R_1$ and R are as defined above; each $R_4$ independently is a $C_{1-6}$ alkyl, or a —$(AO)_{1-6}H$ group where A is a $C_{2-4}$ straight chained or branched alkyl; each $R_5$ independently is a $C_{1-6}$ alkyl; Y is from 1 to 6; x is from 1 to 5; n is the number of moles of monovalent anion $A^-$ to provide a net zero charge; and A is a monovalent anion, and (c) a combination of quats having structural formulas (I) and (II); and (ii) from about 60 to about 97 weight % of a cationic fabric softener agent selected from ester-containing quaternary ammonium compounds (i.e., ester quats), amido amine quaternary ammonium compounds, imidazoline quats and mixtures and salts thereof.

The rinse cycle fabric softener concentrate of the present invention is an emulsion, i.e., it is not clear. Moreover, the inventive concentrate may be further characterized as being a waxy mixture of the aforementioned components. In some embodiments, the inventive concentrate may be used with one or more conventional liquid carriers such as water, $C_{1-4}$ monohydric alcohols, $C_{2-10}$ polyhydric glycols, diols or triols, polyalkenylene glycols, and mixtures thereof to form a liquid rinse cycle fabric softener formulation. In this embodiment of the present invention, the concentration of the inventive rinse cycle fabric softener concentrate in the liquid fabric softener formulation is from about 2 to about 40 weight %.

In a further embodiment of the present invention, a concentrate or formulation containing up to 60 weight % active ingredient is also contemplated.

The rinse cycle fabric softener concentrate or liquid fabric softener formulation of the present invention is used in the rinse cycle of any laundering process where conventional detergents are employed. In one embodiment of the present invention, the inventive concentrate or formulation is used in a laundering liquor where the detergent contains a high level of anionic surfactants. The term "high level of anionics" refers to a detergent composition that contains at least 10% or more of an anionic surfactant. The rinse cycle fabric softener formulation of the present invention is used in an amount of from about 0.05 to about 0.4 grams of said fabric softener actives per 100 grams of fabric to be laundered.

The improved softness that is obtainable using the rinse cycle fabric softener concentrate or formulation of the present invention is attributed to one of the above-mentioned polyquat compounds. Specifically, the polyquat compounds of the present invention serve as an efficient anionic scavenger which inhibits complexation of the anionics with the softening agents.

In addition to improved softness, the inventive rinse cycle fabric softener concentrate or formulation is also effective in preventing dye transfer. Moreover, the presence of the polyquat compounds in the fabric softener unexpectedly increases the water dispersibility of the active agents present in the fabric softener. The increased water dispersibility results in a higher solids rinse cycle fabric softener formulation that contains up to at least 25% of softening actives. More preferably, the rinse cycle fabric softener formulation of the present invention contains from about 2 to about 40% of softening actives.

DETAILED DESCRIPTION OF THE INVENTION

As stated above, the present invention is directed to a rinse cycle fabric softener concentrate and formulation which includes a blend of quaternary ammonium compounds that consists essentially of at least one polyquat as mentioned above and at least one conventional quaternary ammonium fabric softener agent. The fabric softener concentrate of the present invention contains from about 3 to about 40 weight % of the at least one polyquat mentioned above and from about 60 to about 97 weight % of the at least one conventional quaternary ammonium fabric softener agent. In a preferred embodiment of the present invention, the fabric softener concentrate of the present invention contains from about 5 to about 20 weight % of the at least one polyquat component and from about 80 to about 95 weight % of the at least one conventional quaternary ammonium fabric softener agent. In a more highly preferred embodiment of the present invention, the fabric softener concentrate of the present invention contains from about 5 to about 10 weight % of the at least one polyquat component and from about 90 to about 95 weight % of the at least one conventional quaternary ammonium fabric softener agent.

As stated above, the present invention contemplates employing at least one polyquat selected from the group consisting of:

(a) a quat having structural formula (I):

(I)

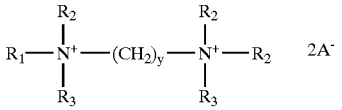

where $R_1$ is a $C_{10-24}$ alkyl, an ester having the formula $R_1C(O)OR$— where $R_1$ is defined above and R is a substituted or unsubstituted $C_{1-6}$ alkylene, or an amide having the formula $R_1C(O)NR$— where $R_1$ and R are as defined above; each $R_2$ independently is a —$(AO)_{1-6}H$ group where A is a $C_{2-4}$ straight chained or branched alkyl; each $R_3$ independently is a $C_{1-6}$ alkyl; Y is from 1 to 6 and A is an anion;

(b) a quat having structural formula (II):

(II)

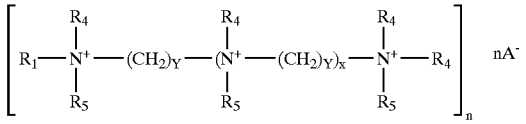

wherein $R_1$ is a $C_{10-24}$ alkyl, an ester having the formula $R_1C(O)OR$— where $R_1$ is defined above and R is a substituted or unsubstituted $C_{1-6}$ alkylene, or an amide of the formula $R_1C(O)NR$— where $R_1$ and R are as defined above; each $R_4$ independently is a $C_{1-6}$ alkyl, or a —$(AO)_{1-6}H$ group where A is a $C_{2-4}$ straight chained or branched alkyl; each $R_5$ independently is a $C_{1-6}$ alkyl; Y is from 1 to 6; x is from 1 to 5; n is the number of moles of monovalent anion $A^-$ to provide a net zero charge; and A is a monovalent anion; and (c) a combination of quats having structural formulas (I) and (II).

When the polyquat is a diquat of structural formula (I), it is preferred that $R_1$ is a $C_{10-24}$ alkyl, more preferably a $C_{12-18}$ alkyl, most preferably tallow; Y is preferably from 1 to 4, more preferably from 2 to 3; each $R_2$ independently is a —$(AO)_{1-4}H$ group where A is a $C_{2-4}$ straight chained or branched alkyl, most preferably a —$(AO)_1H$ group where A is ethyl; and each $R_3$ independently is a $C_{1-4}$ alkyl, with methyl being most highly preferred.

When the polyquat is a triquat of structural formula (II), it is preferred that $R_1$ is a $C_{10-24}$ alkyl, more preferably a $C_{12-18}$ alkyl, most preferably tallow; Y is preferably from 1 to 4, more preferably from 2 to 3; x is from 2 to 4, preferably 2 to 3; each $R_4$ independently is a $CH_3$ or a —$(AO)_{1-4}H$ group where A is a $C_{2-4}$ straight chained or branched alkyl, most preferably a —$(AO)_1H$ group where A is ethyl; and each $R_5$ independently is a $C_{1-4}$ alkyl, with methyl being most highly preferred.

Illustrative examples of polyquats having structural formula (I) and (II) that can be employed in the present invention include, but are not limited to: N tallow N, N', N" trimethyl N, N', N", N" tetraethoxy di-propane triammonium trichloride; N tallow N, N' dimethyl, N, N',N' triethoxy propane diammonium dichloride (ADOGEN 403 diMeCl quat sold by Goldschmidt Chemical Corp.); N tallow heptamethyl dipropane triammonium trichloride; N tallow nonamethyl tri-propane tetraammonium tetrachloride; the reaction product of diethylene triamine with one mole of tallow fatty acid and 3 moles of ethylene oxide and 2 moles of dimethylsulfate; and the reaction product of bis-hexamethyl triamine with 5 moles of ethylene oxide and 1 mole of tallow fatty acid and 3 moles of dimethylsulfate.

Of the various diquats and triquats mentioned above, it is highly preferred that the diquat is N tallow N, N' dimethyl, N, N',N' triethoxy propane diammonium dichloride and the triquat is N tallow heptamethyl dipropane triammonium trichloride.

In both structural formulas (I) and (II), A is a monovalent anion including, but not limited to: chloride, bromide, methyl sulfate, ethyl sulfate, formate, acetate, carbonate, sulfate, nitrate, and other like anions. Preferably, A in each of the above mentioned polyquats is chloride or methyl sulfate.

As stated above, the polyquat component of the fabric softener concentrate of the present invention serves as an anionic scavenger complexing with any anionic detergent species present in the laundering liquor. The polyquats of the present invention have a higher charge density as compared to the other quaternary ammonium compounds present in the blend, therefore, the polyquat has a higher affinity for complexing with the anionics present in the laundering liquor than the other quaternary ammonium compounds present in the rinse cycle fabric softener concentrate. The polyquats of the present invention are made utilizing conventional techniques that are well known in the art.

The other quaternary ammonium compound of the inventive fabric softener concentrate is a conventional cationic fabric softener agent that is selected from the group consisting of ester-containing quaternary ammonium compounds (i.e., ester quats), amido amine quaternary ammonium compounds, imidazoline quats, and mixtures and salts thereof. These quaternary ammonium compounds are well known in the art and are made utilizing conventional processing techniques that are also well known in the art.

The terms "ester-containing quaternary ammonium" or "ester quats" are used herein to denote a quaternary ammonium compound having the following formula:

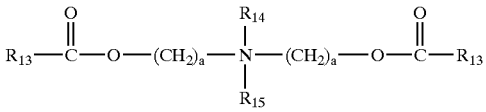

wherein each $R_{13}$ is the same or different and is a saturated or unsaturated $C_{9-23}$, preferably $C_{15-17}$, alkyl; $R_{14}$ and $R_{15}$ are the same or different and are hydrogen, $C_{1-6}$ hydrocarbyl group or hydroxy alkyl; and a is from 1 to 6, preferably 2 to 3. The term "hydrocarbyl" is used herein to denote aliphatic (i.e., a linear or branched, saturated or unsaturated hydrocarbon group, that is, alkyl, alkenyl and alkynyl groups), cycloaliphatic, aryl, alkaryl and aralkyl groups. Salts of the above illustrated ester quats are also contemplated herein. When the ester quat is in salt form, one of the above mentioned anions, A, is associated with the structure shown above.

Examples of ester-containing quats that can be employed in the present invention include, but are not limited to: triethanol amine (TEA) ester quat and methyl diethanol amine (MDEA) ester quat.

The term "amido amine quaternary ammonium compound" is used herein to denote a quaternary ammonium compound having the following formula:

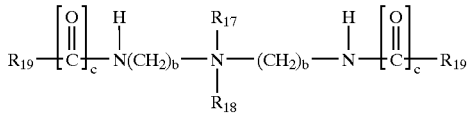

wherein $R_{17}$ is hydrogen or a $C_{1-4}$ alkyl, $R_{18}$ is a $C_{1-4}$ alkyl, ethoxy or propoxy, each $R_{19}$ is the same or different and is a saturated or unsaturated $C_{7-27}$ alkyl or alkenyl group, c is 0 or 1 and b is 1 to 6. Salts of the amido amines having the above formula are also contemplated herein. Examples of amido amine quats that can be employed in the present invention include, but are not limited to: tallow based amido amine dimetyl sulfate based quat (VARISOFT 222LM-90).

The term "imidazoline quat" is used herein to denote a quaternary ammonium compound having one of the following formulas:

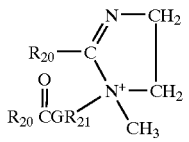

wherein $R_{20}$ is an acyclic alkyl or alkylene $C_{11-21}$ hydrocarbon group; $R_{21}$ is a divalent $C_{1-6}$ alkyl group; and G is O or NH. Salts of the above imidazoline compounds are also contemplated herein. Examples of imidazoline quats that can be employed in the present invention include, but are not limited to: VARISOFT 475 (Methyl, -1-tallow amido ethyl-2-tallow imidazolinium-methyl sulfate).

Of the various cationic quaternary ammonium fabric softeners mentioned above, it is preferred to utilize a triethanol amine (TEA) ester quat as the cationic fabric softener agent. When a TEA ester quat is employed, the ester quat is used in an amount of from about 85 to about 95 weight % in the rinse cycle fabric softener concentrate. A highly preferred TEA ester quat that is employed in the present invention is di-(Nortallow carboxyethyl) hydroxyethyl methylammonium methosulfate.

The rinse cycle fabric softener concentrate of the present invention is a waxy blend, i.e., emulsion, of the above mentioned quaternary ammonium compounds that is made utilizing conventional processes that are well known to those skilled in the art for making fabric softeners. For example, the rinse cycle fabric softener concentrate of the present invention can be made by separately adding each ingredient to a reaction vessel. Mixing by hand, or with a mechanical mixer is typically carried out to ensure that a substantially homogeneous mixture of the components is obtained. The blend may be made at room temperature or, if desired, elevated temperatures can be employed. The ingredients of the blend may be added in a one shot process, or alternatively the ingredients may be added dropwise or in small incremental amounts.

Alternatively, the rinse cycle fabric softener concentrate of the present invention may be made by melting and mixing the individual components together utilizing melt mixing techniques that are well known to those skilled in the art.

The rinse cycle fabric softener concentrate of the present invention, which is a waxy emulsion, may be made into a liquid fabric softener formulation by introducing the same into a liquid carrier under high shear mixing conditions. The mixing may be conducted at room temperature, or alternatively, temperatures of from 40° C. to 90° C. can be employed.

Suitable liquid carriers that may be employed in the present invention include, but are not limited to: water; $C_{1-4}$ monohydric alcohols; $C_{2-10}$ polyhydric glycols, diols, or triols; polyalkenylene glycols; and mixtures and combinations thereof.

In embodiments wherein the inventive rinse cycle fabric softener concentrate is used with a liquid carrier, the inventive rinse cycle fabric softener concentrate is present in a concentration of from about 2 to about 40 weight %.

In addition to liquid carriers, the inventive rinse cycle fabric softener concentrate may be used with other conventional materials that are typically present in liquid rinse cycle fabric softeners. For example, brighteners, soil removers, solvotropes, perfumes, dyes, bactericides, chelating agents, silicones, and the like may be present in the liquid fabric softener formulation of the present invention. The only limitation on the liquid fabric softener of the present invention is that it contains at least the inventive rinse cycle fabric softener concentrate. Since the rinse cycle fabric softener concentrate of the present invention is capable of efficiently inhibiting dye transfer, there is no need to add a separate dye transfer inhibition agent into the inventive liquid rinse cycle fabric softener formulation.

The rinse cycle fabric softener concentrate or formulation of the present invention can be added during the rinse cycle of a laundering process wherein any detergent is present in the laundry liquor. That is, the inventive rinse cycle fabric softener concentrate or formulation can be added to a laundering liquor that contains anionic surfactants, nonionic surfactants, amphoteric surfactants, zwitterionic surfactants or any combinations or mixtures thereof.

In a preferred embodiment of the present invention, the inventive rinse cycle fabric softener concentrate or formulation may be used with any conventional detergent that includes a high level of anionic surfactants present therein. That is, the rinse cycle fabric softener concentrate or formulation of the present invention is used with a detergent that contains from about 10 to about 80 weight % of at least one anionic surfactant. More preferably, the detergent contains from about 30 to about 70 weight % of at least one anionic surfactant.

Suitable anionic surfactants that can be employed in the detergent composition include water soluble salts, preferably the alklai metal, ammonium and alkylammonium salts of organic sulfuric acid reaction products having in their molecular structure an alkyl group containing from about 10 to about 20 carbon atoms and a sulfonic acid or sulfuric acid ester group. (Included in the term "alkyl" is the alkyl portions of acyl groups).

Some illustrative examples of the above type of anionic surfactants are the sodium and potassium alkyl sulfates, especially those obtained by sulfating higher $C_{8-18}$ alcohols, such as those produced by reducing the glycerides of tallow or coconut oil; and the sodium and potassium alkylbenzene sulfonates in which the alkyl group is straight chained or branched, and the alkyl contains from about 9 to about 15 carbon atoms. The alkylbenzene sulfonates of the former type are described, for example, in U.S. Pat. Nos. 2,220,099 and 2,477,383.

Especially preferred alkylbenzene sulfonates are linear straight chain alkylbenzene sulfonates in which the average number of carbon atoms in the alkyl group is from about 10 to 15, abbreviated as $C_{10-15}$ LAS. The alkali salts, particularly the sodium salts of these anionic surfactants are preferred. Alkylbenzene sulfonates and processes for producing the same are disclosed, for example, in U.S. Pat. Nos. 2,220,099 and 2,477,383.

Other anionic surfactants that can be employed in the detergent composition include alkyl alkoxylated sulfates. These compounds are water-soluble salts or acids having the formula $RO(A)_mSO_3M$ wherein R is an unsubstituted $C_{10-24}$ alkyl or hydroxyalkyl group having a $C_{10-18}$ alkyl or hydroxyalkyl group, A is an ethoxy or propoxy unit, m is greater than zero, preferably m is between about 0.5 and about 6, and M is hydrogen or a water soluble cation which can be, for example, a metal cation (e.g., sodium, potassium, lithium, calcium, magnesium, etc.), ammonium or substituted-ammonium cation. Specific examples of substituted ammonium cations include, but are not limited to: methyl-, ethyl-, dimethyl-, trimethyl-ammonium and quaternary ammonium cations, such as tetramethyl-ammonium, dimethyl piperdinum and cations derived from alkanolamines such as monoethanolamine, diethanolamine and triethlamine, and mixtures thereof.

Illustrative examples of the foregoing alkyl alkoxylated sulfates include: $C_{12-18}$ alkyl polyethoxylate (1.0) sulfate, $C_{12-18}$ alkyl polyethoxylate (2.25) sulfate, $C_{12-18}$ alkyl polyethoxylate (3.0) sulfate, $C_{12-18}$ alkyl polyethoxylate (4.0) sulfate, wherein M is sodium or potassium.

Other anionic surfactants useful in the detergent composition include sodium alkyl glyceryl ether sulfonates, particularly those ethers of higher alcohols derived from tallow and coconut oil; sodium coconut oil fatty acid monoglyceride sulfonates and sulfates.

Still further anionic surfactants include water-soluble salts of esters of alpha-sulfonated fatty acids containing from about 6 to about 20 carbon atoms in the fatty acid portion of the compound and from 1 to about 10 carbon atoms in the ester group; water-soluble salts of 2-acyloxyalkane-1-sulfonic acids containing from about 2 to about 9 carbon atoms in the acyl portion of the compound and from about 9 to about 23 carbon atoms in the alkane moiety; water-soluble salts of olefin and paraffin sulfonates containing from about 12 to about 20 carbon atoms; and beta-alkyloxy alkane sulfonates containing from 1 to about 3 carbon atoms in the alkyl group and from about 8 to about 20 carbon atoms in the alkane moiety.

In addition to anionic surfactants, the detergent may optionally include one or more nonionic surfactants therein. Typical nonionic surfactants that can be present in the detergent composition include polyethylene, polypropylene and polybutylene oxide condensates of alkyl phenols. Other examples of nonionic surfactants include: condensation products of primary and secondary aliphatic alcohols, alkylpolysaccharides, condensation products of ethylene oxide with a hydrophobic base formed by the condensation of propylene oxide with propylene glycol, condensation products of ethylene oxide with the product resulting from the reaction of propylene oxide and ethylenediamine, and polyhydroxy fatty acid amides.

The detergent may also include any conventional amphoteric or zwitterionic surfactant. It is noted that the use of the inventive rinse cycle fabric softener formulation is not limited to a specific type of detergent, but rather the rinse cycle fabric softener formulation of the present invention can be used with any conventional detergent.

In addition to the above ingredients, the detergent composition may also include conventional detergent builders, enzymes, bleaching agents, bleach activators, polymeric soil release agents, chelating agents, soil release and anti-redeposition agents, dispersing agents, optical brighteners, whitening agents, betaines, sultanies and other like components that may be typically used in laundry detergents. Since all these compounds are conventional, a detailed description of the optional components is not provided herein. A detailed description of these detergent components however can be found in WO 98/53034, the contents of which is incorporated herein by reference.

Operational Use

The rinse cycle fabric softener concentration or formulation of the present invention is typically added to the rinse cycle of a laundry process utilizing conventional washing temperatures of about 20° C. to about 60° C. and rinsing temperatures of about 10° C. to about 50° C. The rinse cycle fabric softener concentrate or formulation of the present invention is effective over a wide range of water hardness levels.

The rinse cycle fabric softener concentrate or formulation of the present invention may be used in laundering operations by adding the formulation to a laundering vessel in amounts that are typically used. Specifically, the inventive rinse cycle formulation of the present invention is used in an amount of from about 20 g to about 120 g solids content of fabric softener with a 3 to 8 pound load of clothing to be washed. The particular amount of fabric softener used in the rinsing cycle is not however critical to the present invention.

The following examples are given to illustrate the present invention and to demonstrate some advantages that can be obtained from utilizing the same.

Softness of a washed article such as a cotton terry towel is typically determined by using a simple ranking test. In such testing, each washed article is placed in order from best to worst. The worst sample is given a 1, the second worst is given a 2, up to the best which is given the number equal to the number of samples being compared. No ties are allowed. Ranking is the simplest way to perform comparisons since no trained panel is required; however, the data is oftentimes not very informative. Ranking gives ordinal data (consecutive samples which differ a lot as well as those that are very close will be separated by one rank unit), which is difficult to quantify.

To better quantify ranking data, Friedman statistical analysis is employed in the present invention. Friedman analysis makes use of the sum of the ranking data for each sample. For a large enough panel, Friedman analysis is similar to the F test in ANOVA analysis. Using Friedman analysis, one can compute the least significant difference (LSD) between two rank sums that is statistically meaningful.

LSD depends on the number of samples and the number of panel members employed. For example, when 32 panel members are used the LSD is computed for various samples sizes.

Three samples: 16

Four samples: 20

Five samples: 25

Samples with a difference in rank sums greater than the LSD are considered statistically different. Samples with differences less than LSD are considered to be statistically equal. This is a rigorous way of saying that if two samples are close together they are confused in the ranking order by more judges than two samples that are very different.

The rank sum score for a given sample depends on the other samples it was compared to. Comparison of the same sample's rank sum score from two different groups is meaningless.

In the following examples, standard North American washing conditions are employed. Specifically a Kenmore washing machine and a Kenmore electrical dryer were used. Washing was carried out as follows:

Warm Wash 30° C.

Cold Rinse 11° C.

45 grams of a commercial available anionic-containing detergent 1700 grams of fabric (cotton terry towels and sheets)

Softener dosage=0.2% based on the softener actives per weight of fabric

EXAMPLE 1

In this example, a polyquat in accordance with formula (II) was blended with a TEA ester quat fabric softener active using 5 and 10 percent by weight quat. Specifically, the triquat employed in this example was N tallow heptamethyl dipropane triammonium trichloride, while the TEA ester quat was di-(Nortallow carboxyethyl) hydroxyethyl methylammonium methosulfate.

For comparative purposes, N-tallow pentamethyl propane diammonium dichloride, which is a representative diquat disclosed in U.S. Pat. No. 6,083,899 to Baker, et al. (see formula iv at Col. 3, lines 36–54), was also blended with the above-mentioned TEA ester quat. A national brand fabric softener (National Brand D) which does not include one of the inventive polyquats was also used. The dosage of each fabric softener used in this example was 0.2 gm of active fabric softener/gm dry fabric weight. The results of this example, in terms of Friedman statistics, are as follows:

| Sample | Friedman Analysis |
|---|---|
| 90% di-(Nortallow carboxyethyl) hydroxyethyl methylammonium methosulfate + 10 % triquat (Inventive blend) | 115 |
| National Brand D (Prior Art) | 95 |
| 95% di-(Nortallow carboxyethyl) hydroxyethyl methylammonium methosulfate + 5% triquat (Inventive blend) | 71 |
| 95% di-(Nortallow carboxyethyl) hydroxyethyl methylammonium methosulfate + 5% N-tallow pentamethyl propane diammonium dichloride (Prior Art) | 39 |

The data in the above table demonstrates that the inventive blend comprising 90% di-(Nortallow carboxyethyl) hydroxyethyl methylammonium methosulfate+10% triquat provided a dramatic and surprisingly improved softening as compared to either a conventional national brand fabric softener or a prior art blend. It is noted that the inventive blend comprising 95% di-(Nortallow carboxyethyl) hydroxyethyl methylammonium methosulfate+5% triquat gave a surprisingly greater softness as compared to the prior art blend.

EXAMPLE 2

In this example, a polyquat in accordance formula (I) was blended with a TEA ester quat fabric softener active. Specifically, the diquat employed in this example was N tallow N, N' dimethyl N, N', N' triethoxy propane diammonium dichloride (to be referred to as "ADOGEN 403 diMeCl quat"), while the TEA ester quat was di-(Nortallow carboxyethyl) hydroxyethyl methylammonium methosulfate.

For comparative purposes, N-tallow pentamethyl propane diammonium dichloride, which is a representative diquat disclosed in U.S. Pat. No. 6,083,899 to Baker, et al. (see formula iv at Col. 3, lines 36–54), was also blended with the above-mentioned TEA ester quat.

The results of this example, in terms of Friedman statistics, are as follows:

| Sample | Friedman Analysis |
|---|---|
| 90% di-(Nortallow carboxyethyl) hydroxyethyl methylammonium methosulfate + 10% ADOGEN 403 diMeCl quat (Inventive blend) | 123 |
| 95% di-(Nortallow carboxyethyl) hydroxyethyl methylammonium methosulfate + 5% ADOGEN 403 diMeCl quat (Inventive blend) | 88 |
| 92.5% di-(Nortallow carboxyethyl) hydroxyethyl methylammonium methosulfate + 7.5% N-tallow pentamethyl propane diammonium dichloride (Prior Art) | 64 |

The above data illustrates that the blends containing ADOGEN 403 diMeCl quat provide a substantial improved softening as compared to the prior art blend that contains 7.5% N-tallow pentamethyl propane diammonium dichloride, even when less anionic scavenger is employed.

ADOGEN 403 diMeCi quat was tested against N-tallow pentamethyl propane diammonium dichloride without the TEA ester quat to determine the relative strength of the compounds. Each compound was tested with and without detergent in the wash cycle. The following results were obtained:

| Sample | Friedman Analysis |
|---|---|
| N-tallow pentamethyl propane diammonium dichloride with detergent | 114 |
| ADOGEN 403 diMeCl quat with detergent | 82 |
| N-tallow pentamethyl propane diammonium dichloride without detergent | 76 |
| ADOGEN 403 diMeCl quat without detergent | 48 |

The above results demonstrate that both compounds work better with detergent in the wash cycle. ADOGEN 403 diMeCi quat had less softening ability than N-tallow pentamethyl propane diammonium dichloride when applied by itself without another standard softener. Previous data had shown its synergism when used with another conventional ester quat type softener.

ADOGEN 403 diMeCl quat and N-tallow pentamethyl propane diammonium dichloride were then separately added to the TEA ester quat, di-(Nortallow carboxyethyl) hydroxyethyl methylammonium methosulfate, and those blends were used with a detergent in the wash cycle. The results of this testing are as follows:

| Sample | Friedman Analysis |
|---|---|
| 90% di-(Nortallow carboxyethyl) hydroxyethyl methylammonium methosulfate + 10% ADOGEN 403 diMeCl quat | 108 |
| 90% di-(Nortallow carboxyethyl) hydroxyethyl methylammonium methosulfate + 10% N-tallow pentamethyl propane diammonium dichloride | 107 |

-continued

| Sample | Friedman Analysis |
|---|---|
| 95% di-(Nortallow carboxyethyl) hydroxyethyl methylammonium methosulfate + 5% ADOGEN 403 diMeCl quat | 60 |
| 95% di-(Nortallow carboxyethyl) hydroxyethyl methylammonium methosulfate + 5% N-tallow pentamethyl propane diammonium dichloride | 45 |

The data illustrates that ADOGEN 403 diMeCl quat provides an improved boost to the TEA ester quat than N-tallow pentamethyl propane diammonium dichloride.

EXAMPLE 3

In this example, the triquat used in Example 1, ADOGEN 403 diMeCl quat, N-tallow pentamethyl propane diammonium dichloride, and National Brand S were compared using twice the normal amount of detergent in the wash cycle. The results are as follows:

| Sample | Friedman Analysis |
|---|---|
| 90% di-(Nortallow carboxyethyl) hydroxyethyl methylammnonium methosulfate + 10% triquat | 108 |
| 90% di-(Nortallow carboxyethyl) hydroxyethyl methylammonium methosulfate + 10% ADOGEN 403 diMeCl quat | 85 |
| 92.5% di-(Nortallow carboxyethyl) hydroxyethyl methylammonium methosulfate + 7.5%, N-tallow pentamethyl propane diammonium dichloride | 83 |
| National Brand S | 44 |

These results show that the triquat is superior to any other samples tested, and that ADOGEN 403 diMeCl quat is at least as effective as the prior art diquat, N-tallow pentamethyl propane diammonium dichloride, in boosting TEA ester quat performance.

While the present invention has been particularly shown and described with respect to preferred embodiments thereof, it will be understood by those skilled in the art that the foregoing and other changes in form and detail may be made without departing from the spirit and scope of the present invention. It is therefore intended that the present invention not be limited to the exact forms described and illustrated, but fall within the scope of the appended claims.

What is claimed is:

1. A rinse cycle fabric softener concentrate consisting essentially of a blend of:

(i) from about 3 to about 40 weight % of at least one polyquat selected from the group consisting of:

(a) a quat having structural formula (I):

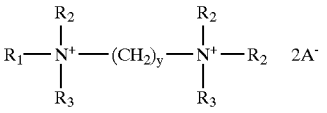

(I)

where $R_1$ is a $C_{10-24}$ alkyl, an ester having the formula $R_1C(O)OR$— where $R_1$ is defined above and R is a substituted or unsubstituted $C_{1-6}$ alkylene, or an amide having the formula $R_1C(O)NR$— where $R_1$ and R are as defined above; each $R_2$ independently is a —$(AO)_{1-6}H$ group where A is a $C_{2-4}$ straight chained or branched alkyl; each $R_3$ independently is a $C_{1-6}$ alkyl; Y is from 1 to 6 and A is an anion, (b) a quat having structural formula (II):

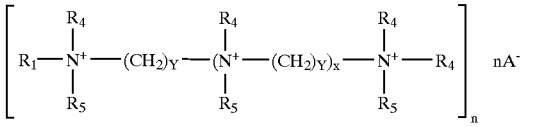

(II)

wherein $R_1$ is a $C_{10-24}$ alkyl, an ester having the formula $R_1C(O)OR$— where $R_1$ is defined above and R is a substituted or unsubstituted $C_{1-6}$ alkylene, or an amide of the formula $R_1C(O)NR$— where $R_1$ and R are as defined above; each $R_4$ independently is a $C_{1-6}$ alkyl, or a —$(AO)_{1-6}H$ group where A is a $C_{2-4}$ straight chained or branched alkyl; each $R_5$ independently is a $C_{1-6}$ alkyl; Y is from 1 to 6; x is from 1 to 5; n is the number of moles of monovalent anion $A^-$ to provide a net zero charge; and A is a monovalent anion, and (c) a combination of quats having structural formulas (I) and (II); and (ii) from about 60 to about 97 weight % of a cationic fabric softener agent, said agent being selected from the group consisting of ester-containing quaternary ammonium compounds, amido amine quaternary ammonium compounds, imidazoline quats and mixtures and salts thereof.

2. The rinse cycle fabric softener concentrate of claim 1 wherein said blend comprises from about 5 to about 20 weight % of said polyquat and from about 80 to about 95 weight % of said cationic fabric softener agent.

3. The rinse cycle fabric softener concentrate of claim 2 wherein said blend comprises from 5 to about 10 weight % of said polyquat and from about 90 to about 95 weight % a of said cationic fabric softener agent.

4. The rinse cycle fabric softener concentrate of claim 1 wherein said polyquat is a quat having structural formula (I).

5. The rinse cycle fabric softener concentrate of claim 4 wherein $R_1$ is a $C_{10-24}$ alkyl, Y is from 1 to 4; each $R_2$ independently is a —$(AO)_{1-4}H$ group where A is a $C_{2-4}$ straight chained or branched alkyl $C_{2-6}$; and each $R_3$ independently a $C_{1-4}$ alkyl.

6. The rinse cycle fabric softener concentrate of claim 5 wherein $R_1$ is tallow.

7. The rinse cycle fabric softener concentrate of claim 5 wherein $R_3$ is methyl.

8. The rinse cycle fabric softener of claim 5 wherein $R_2$ is a —$(AO)_1H$ group where A is ethyl.

9. The rinse cycle fabric softener concentrate of claim 1 wherein said quat of formula (I) is N tallow N,N' dimethyl N,N'N' triethoxy propane diammonium dichloride.

10. The rinse cycle fabric softener concentrate of claim 1 wherein said polyquat is a quat having structural formula (II).

11. The rinse cycle fabric softener of claim 10 wherein $R_1$ is a $C_{10-24}$ alkyl; Y is from 1 to 4; x is from 2 to 4; each $R_4$ independently is $CH_3$ or a —$(AO)_{1-4}H$ group where A is a $C_{2-4}$ straight chained or branched alkyl and each $R_5$ independently is a $C_{1-4}$ alkyl.

12. The rinse cycle fabric softener concentrate of claim 11 wherein $R_1$ is tallow.

13. The rinse cycle fabric softener concentrate of claim 11 wherein $R_5$ is methyl.

14. The rinse cycle fabric softener concentrate of claim 11 wherein $R_4$ is a —$(AO)_1H$ group where A is ethyl.

15. The rinse cycle fabric softener concentrate of claim 1 wherein said quat of formula (II) is N heptamethyl dipropane triammonium trichloride.

16. The rinse cycle fabric softener concentrate of claim 1 wherein said cationic fabric softener agent is an ester-containing quaternary ammonium compound or salt thereof.

17. The rinse cycle fabric softener concentrate of claim 16 wherein said ester-containing quaternary ammonium compound is a compound having the formula:

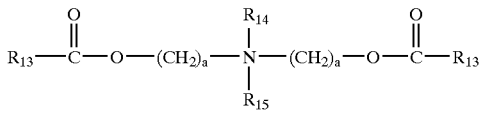

wherein each $R_{13}$ is the same or different and is a $C_{9-23}$ alkyl; $R_{14}$ and $R_{15}$ are the same or different and are hydrogen, $C_{1-4}$ hydrocarbyl group or hydroxy alkyl; and a is from 1 to 6.

18. The rinse cycle fabric softener concentrate of claim 17 wherein said ester-containing quaternary ammonium compound is a TEA ester quat.

19. The rinse cycle fabric softener concentrate of claim 1 wherein said cationic fabric softener agent is an amido amine quaternary ammonium compound or a salt thereof.

20. The rinse cycle fabric softener concentrate of claim 19 wherein said amido amine quaternary ammonium compound is a compound having the formula:

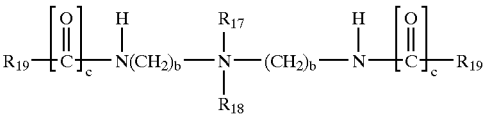

wherein $R_{17}$ is hydrogen or a $C_{1-4}$ alkyl, $R_{18}$ is a $C_{1-4}$ alkyl, ethoxy or propoxy, each $R_{19}$ is the same or different and is a $C_{7-27}$ alkyl or alkenyl group, c is 0 or 1, and b is 1 to 6.

21. The rinse cycle fabric softener concentrate of claim 1 wherein said cationic fabric softener agent is an imidazoline quaternary ammonium compound or a salt thereof.

22. The rinse cycle fabric softener concentrate of claim 21 wherein said imidazoline quaternary ammonium compound is a compound having the following formula:

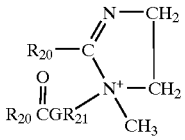

wherein $R_{20}$ is an acyclic alkyl or alkylene $C_{11-21}$ hydrocarbon group; $R_{21}$ is a divalent $C_{1-6}$ alkyl group; G is O or NH and A is a monovalent anion.

23. A method of laundering fabrics comprising the steps of:

(a) washing a fabric in water in the presence of a detergent; and (b) rinsing the washed fabric of step (a) in the presence of at least the rinse cycle fabric softener concentrate of claim 1, said rinse cycle fabric softener concentrate is effective in providing improved softness and dye inhibition to said fabric.

24. The method of claim 23 wherein said detergent is comprised of at least one anionic surfactant.

* * * * *